US009387699B2

(12) United States Patent
Sasaki et al.

(10) Patent No.: US 9,387,699 B2
(45) Date of Patent: Jul. 12, 2016

(54) LIQUID EJECTING APPARATUS

(71) Applicant: SEIKO EPSON CORPORATION, Tokyo (JP)

(72) Inventors: Tsuneyuki Sasaki, Matsumoto (JP); Hiroshi Yoshida, Shiojiri (JP); Eiji Kumai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/475,290

(22) Filed: Sep. 2, 2014

(65) Prior Publication Data

US 2015/0062272 A1 Mar. 5, 2015

(30) Foreign Application Priority Data

Sep. 3, 2013 (JP) ..... 2013-181899

(51) Int. Cl.
*B41J 29/38* (2006.01)
*B41J 11/00* (2006.01)

(52) U.S. Cl.
CPC ..... *B41J 11/002* (2013.01)

(58) Field of Classification Search
CPC ..... B41J 11/002; B41J 29/38; B41J 2/01; B41J 11/0015; B41M 7/0072; C09D 11/101
See application file for complete search history.

(56) References Cited

U.S. PATENT DOCUMENTS

| | | | | |
|---|---|---|---|---|
| 6,893,122 | B2 * | 5/2005 | Shima et al. | 347/102 |
| 8,162,470 | B2 * | 4/2012 | Kanai et al. | 347/102 |
| 2009/0231387 | A1 * | 9/2009 | Shinkawa | 347/34 |

FOREIGN PATENT DOCUMENTS

| | | |
|---|---|---|
| JP | 2001-096727 | 4/2001 |
| JP | 2012-013297 | 1/2012 |

* cited by examiner

*Primary Examiner* — Julian Huffman
*Assistant Examiner* — Jeremy Delozier
(74) *Attorney, Agent, or Firm* — Workman Nydegger

(57) ABSTRACT

A liquid ejecting apparatus includes an ejection section that ejects a liquid, a medium supporting section that supports a medium onto which the liquid is ejected, a heater that is disposed at a position which is not in contact with the medium supporting section and is configured to emit a thermal energy, a heat receiving section that receives the thermal energy emitted from the heater, and a stop section that stops the heater when a temperature of the heat receiving section becomes a predetermined temperature or higher, wherein the heat receiving section is disposed at a position on a first direction side with respect to the heater and between the heater and the medium supporting section, when the first direction is defined as a direction which is directed from the heater to the medium supporting section.

8 Claims, 3 Drawing Sheets

LIQUID EJECTING APPARATUS

BACKGROUND

1. Technical Field

The present invention relates to a liquid ejecting apparatus and, more specifically, to a liquid ejecting apparatus which includes a heater that emits thermal energy.

2. Related Art

Liquid ejecting apparatuses which include a heater that emits thermal energy have been known. The heater is mainly used to dry the liquid which is ejected onto a medium. In this case, if an abnormality occurs in the heater, the thermal energy emitted from the heater becomes too large and may cause the apparatus or the medium to be excessively heated. In light of that, in the liquid ejecting apparatus which includes a heater, a configuration is known in which a stop section is provided so as to stop the heater when a detected temperature becomes a predetermined temperature or higher. Further, a configuration is also known in which a heat receiving section is provided so as to directly or indirectly receive the thermal energy near the heater in order to operate the stop section.

For example, JP-A-2001-96727 discloses an ink jet recording apparatus in which a thermistor is provided immediately above a halogen lamp and is configured to directly receive the thermal energy emitted from the halogen lamp. In this configuration, a medium is supported by a group of rollers immediately under the halogen lamp. That is, the halogen lamp is disposed between the thermistor and the group of rollers.

In the recording apparatus as disclosed in JP-A-2001-96727 in which the halogen lamp is disposed between the thermistor and the group of rollers, the thermistor receives the thermal energy which is directed in the direction away from the medium among the thermal energy emitted from the halogen lamp. As a result, when an abnormality occurs in the halogen lamp, there is a risk of the medium being excessively heated.

SUMMARY

An advantage of some aspects of the invention is that a liquid ejecting apparatus of the following embodiment and applied examples is provided.

Applied Example 1

According to an aspect of the invention, a liquid ejecting apparatus includes an ejection section that ejects a liquid, a medium supporting section that supports a medium onto which the liquid is ejected, a heater that is disposed at a position which is not in contact with the medium supporting section and is configured to emit a thermal energy, a heat receiving section that receives the thermal energy emitted from the heater, and a stop section that stops the heater when a temperature of the heat receiving section becomes a predetermined temperature or higher, wherein the heat receiving section is disposed at a position on a first direction side with respect to the heater and between the heater and the medium supporting section, when the first direction is defined as a direction which is directed from the heater to the medium supporting section.

With this configuration, the heat receiving section can receive the thermal energy which is directed from the heater to the medium. Then, when the temperature of the heat receiving section becomes a predetermined temperature or higher by receiving the thermal energy directed from the heater to the medium, the stop section stops the heater. Accordingly, the heater can be stopped before the thermal energy emitted from the heater reaches the excessive heating level that causes the temperature of the medium to be raised to a predetermined temperature or higher.

Applied Example 2

In the above liquid ejecting apparatus, it is preferable that the heater includes a first area which opposes the medium when the medium is supported by the medium supporting section and a second area which does not oppose the medium when the medium is supported by the medium supporting section, and the heat receiving section is disposed at a position which opposes the second area of the heater.

With this configuration, the heat receiving section can receive the thermal energy which is directed from the heater to the medium without interrupting the thermal energy emitted onto the medium. Accordingly, the heater can be stopped before the thermal energy emitted from the heater reaches the excessive heating level while allowing a sufficient thermal energy to be emitted onto the medium.

Applied Example 3

In the above liquid ejecting apparatus, it is preferable that the heater has a configuration in which an output of the thermal energy in an area which opposes the heat receiving section is higher than an output of thermal energy in an area which does not oppose the heat receiving section.

With this configuration, the temperature of the heat receiving section is easily increased compared with the temperature of the medium, which facilitates the operation of the stop section. Accordingly, the heater can be stopped in a reliable manner before the thermal energy emitted from the heater reaches the excessive heating level.

Applied Example 4

In the above liquid ejecting apparatus, it is preferable that the heat receiving section has a thermal diffusivity of 80 ($m^2$/sec) or more.

With this configuration, a necessary period of time from when the heat receiving section receives the thermal energy to when the temperature of the heat receiving section increases is shortened. Accordingly, the heater can be quickly stopped before the thermal energy emitted from the heater reaches the excessive heating level.

Applied Example 5

In the above liquid ejecting apparatus, it is preferable that the heat receiving section has an emissivity of 0.8 or more.

With this configuration, the absorptivity of thermal energy of the heat receiving section is improved and the temperature of the heat receiving section is easily increased. Accordingly, the heater can be stopped in a reliable manner before the thermal energy emitted from the heater reaches the excessive heating level.

Applied Example 6

In the above liquid ejecting apparatus, it is preferable that the heat receiving section has a thickness of 0.3 mm or less.

With this configuration, the heat capacity of the heat receiving section is reduced and the temperature of the heat receiving section is easily increased. Accordingly, the heater can be stopped in a reliable manner before the thermal energy emitted from the heater reaches the excessive heating level.

Applied Example 7

In the above liquid ejecting apparatus, it is preferable that a cover member that covers at least part of the stop section is provided.

With this configuration, the stop section can be prevented from being affected by external factors. Accordingly, the heater can be stopped in a reliable manner before the thermal energy emitted from the heater reaches the excessive heating level. Further, the stop section can be protected from external factors, thereby preventing a failure of the stop section due to external factors.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the drawings. Throughout the drawings, the components are not necessarily drawn to scale so that the components are shown in recognizable sizes. Further, X, Y, and Z axes are shown in each drawing. A direction from the proximal end to the distal end of the arrow of each axis represents a positive direction, while a direction from the distal end to the proximal end represents a negative direction. In the X and Y axes, the proximal end of the arrow is defined as upstream end, while the distal end of the arrow is defined as downstream end. Further, in the Z axis, the proximal end of the arrow is defined as lower end, while the distal end of the arrow is defined as upper end.

Embodiment

Figure 1A:
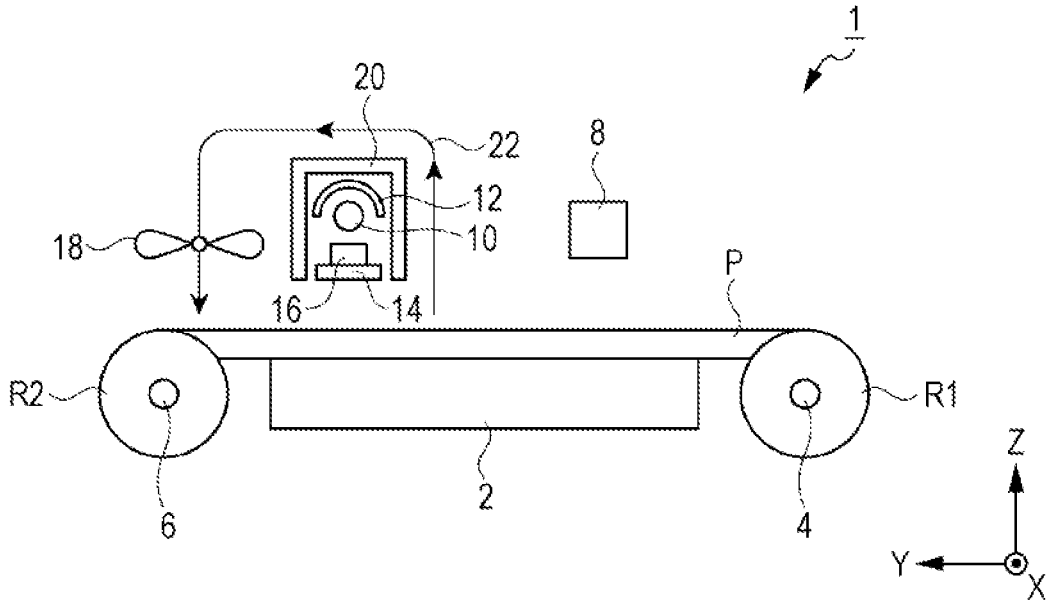
FIG. 1A is a schematic side view of a liquid ejecting apparatus according to an embodiment.
Figure 1B:
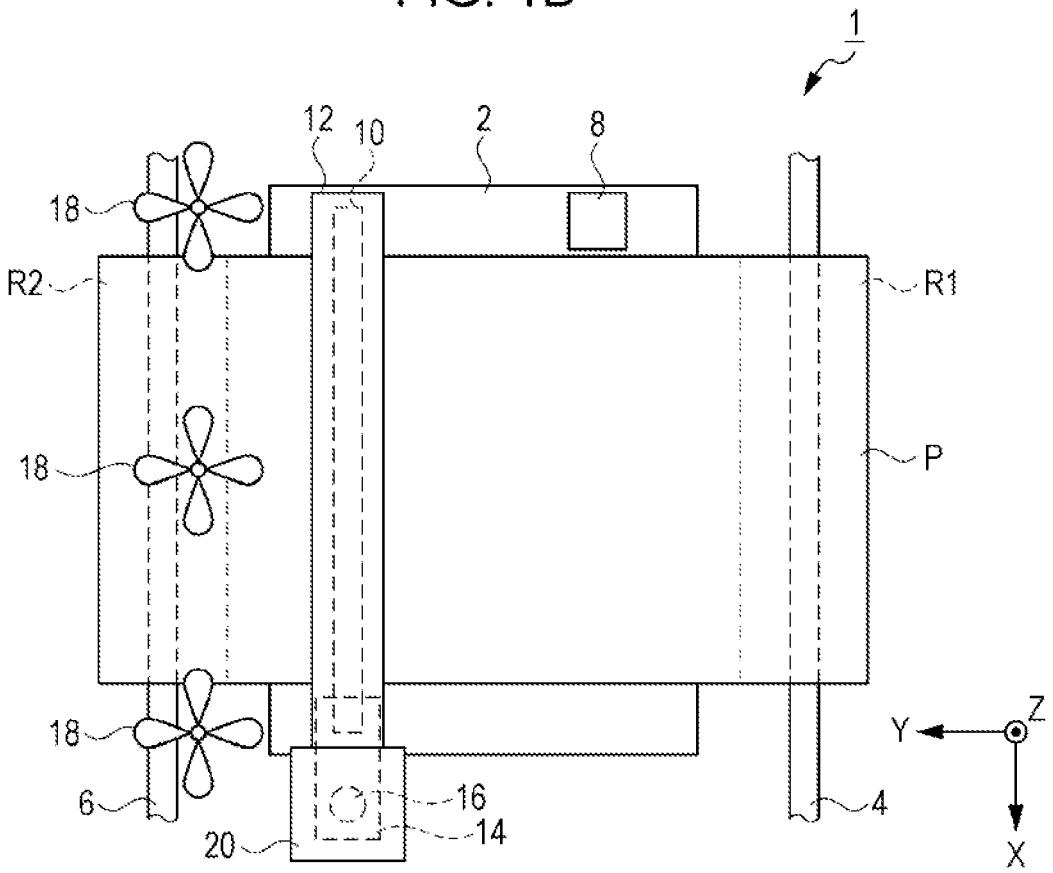
FIG. 1B is a schematic plan view of the liquid ejecting apparatus according to the embodiment.

First, a liquid ejecting apparatus according to an embodiment will be described below. A liquid ejecting apparatus 1 is a liquid ejecting apparatus that is configured to form an image on a medium by ejecting a liquid onto the medium. Specifically, the liquid ejecting apparatus 1 includes a printer. FIGS. 1A and 1B are views which show the liquid ejecting apparatus 1 according to the embodiment. FIG. 1A is a schematic side view of the liquid ejecting apparatus 1, and FIG. 1B is a schematic plan view of the liquid ejecting apparatus 1.

The liquid ejecting apparatus 1 includes a set section 4 in which a medium P can be set. The medium P is a medium on which image forming is performed by the liquid ejecting apparatus 1. The set section 4 is configured to rotate so as to feed a roll R1 of the medium P which is set in the set section 4. The medium P is transported in a transportation direction which is the positive direction of the Y axis. Further, the medium P may be transported in a reverse transportation direction which is the negative direction of the Y axis. The transportation in the reverse transportation direction is referred to as reverse transportation or backward feed. The reverse transportation may be used for positional adjustment of the medium P. Although the liquid ejecting apparatus 1 uses a roll-type medium as the medium P, a single sheet type medium may be also used.

Further, the liquid ejecting apparatus 1 includes a transportation roller, which is not shown in the figure. The transportation roller serves as a transportation section that transports the medium P in the transportation direction. The transportation section can also perform the above-mentioned reverse transportation.

The liquid ejecting apparatus 1 further includes a medium supporting section 2 at a position downstream to the set section 4 in the transportation direction. The medium supporting section 2 serves as a medium supporting section that supports a medium. Specifically, the medium supporting section 2 supports the medium P when the medium P is placed on a supporting surface of the medium supporting section 2.

The liquid ejecting apparatus 1 further includes a head (ejection section) 8 that is configured to eject the liquid onto the medium P. The head 8 serves as an ejection section that ejects the liquid. The head 8 is capable of reciprocating in an intersecting direction that intersects with the transportation direction of the medium P. The intersecting direction is a direction which is not parallel with the transportation direction and includes the positive and negative directions of the X axis. When the head 8 ejects the liquid while moving in the intersecting direction, an image is formed on the medium P which is supported by the medium supporting section 2. At this time, the medium supporting section 2 serves as a medium supporting section that supports the medium P on which the liquid is ejected.

The liquid which can be ejected from the head 8 may include, for example, ink which contains solute and solvent. The ink to be used in the liquid ejecting apparatus 1 may include ink of specific colors. For example, cyan ink, magenta ink, yellow ink, black ink, light cyan ink, light magenta ink, white ink, gray ink, light gray ink, orange ink, green ink and metallic ink may be used. In this case, ink contains color materials such as dye and pigment.

In addition, the ink to be used in the liquid ejecting apparatus 1 may include clear ink which does not have a color. The clear ink herein is an ink which does not contain a coloring material or contains a slight amount of coloring material. That is, the colorless clear ink refers to an ink which is visually recognized as colorless.

A heater 10 is disposed at a position downstream to the head 8 in the transportation direction. The heater 10 is disposed at a position which is not in contact with the medium supporting section 2. Further, the heater 10 is disposed at a position which opposes the medium supporting section 2. When the medium P is supported by the medium supporting section 2, the heater 10 opposes the medium P. In this state, the heater 10 and the medium supporting section 2 oppose to each other with the medium P interposed therebetween. The term "oppose" as used herein refers to a state in which one object at least partially opposes the other object.

The heater 10 can emit a thermal energy. By emitting a thermal energy to an object, the object can be dried. The object may be, for example, the medium P or the ink ejected onto the medium P. When the medium P is supported by the medium supporting section 2, the heater 10 can emit a thermal energy to the medium P. The heater 10 may include, for example, a heater that emits an infrared radiation. However, types, shapes and installation positions of the heater 10 are not particularly limited. For example, the heater 10 may be a heater that emits an ultraviolet radiation or a fan heater that blows heated air. Preferably, the heater 10 applies thermal energy to the object without being in contact with the object. The output of thermal energy from the heater 10 of this embodiment is uniform in the intersecting direction. The term "uniform" as used herein means that the output is not intentionally increased or decreased. That is, the "uniform" includes a case where an output difference occurs due to errors or the like.

Further, a reflector 12 is disposed above the heater 10. The reflector 12 serves as a reflecting section that reflects a portion of the thermal energy emitted from the heater 10 which is not directed to the medium P and allows it to be directed to the medium P. Accordingly, the thermal energy directed to the medium P is increased, thereby improving a heating efficiency of the medium P.

Further, a winding section 6 that is configured to wind up the medium P is disposed downstream to the head 8 in the transportation direction. The winding section 6 is configured to rotate so as to wind up the medium P and form a roll R2 of the medium P.

The liquid ejecting apparatus 1 further includes a heat receiving section 14 that receives the thermal energy emitted from the heater 10. When a direction from the heater 10 to the medium supporting section 2 is defined as a first direction, the heat receiving section 14 is disposed at a position on the first direction side with respect to the heater 10 and between the heater 10 and the medium supporting section 2. Since the heat receiving section 14 is disposed between the heater 10 and the medium supporting section 2, the heat receiving section 14 can receive the thermal energy which is directed from the heater 10 to the medium supporting section 2. When the medium P is supported by the medium supporting section 2, the heat receiving section 14 can receive the thermal energy which is directed from the heater 10 to the medium P. As the heat receiving section 14 receives the thermal energy emitted from the heater 10, the temperature rises.

The liquid ejecting apparatus 1 further includes a stop section 16 that is configured to stop the heater 10 when the temperature of the heat receiving section 14 becomes a predetermined temperature or higher. The stop section 16 detects a temperature of a detection target and performs a shut off operation when the temperature of the detection target becomes a predetermined temperature or higher. The shut off operation is an operation to shut off supplying the energy to a shut off target and stop the operation of the shut off target. For example, in the case where the shut off target is operated by electricity, power supply to the shut off target is shut off. In this embodiment, the detection target is the heat receiving section 14 and the shut off target is the heater 10. In this configuration, the stop section 16 serves as a safety device that prevents the output of thermal energy emitted from the heater 10 from being excessively increased.

In this embodiment, the stop section 16 is disposed at a position that allows the stop section 16 to detect the temperature of the heat receiving section 14. Specifically, the stop section 16 is disposed at a position which is in contact with the heat receiving section 14. When the temperature of the heat receiving section 14 becomes a predetermined temperature or higher, the stop section 16 stops the heater 10. The term "stops the heater 10" herein means to stop voluntary emission of the thermal energy from the heater 10. However, even after the heater 10 stops, the heater 10 may continue to release thermal energy as residual heat.

When a predetermined temperature that allows the stop section 16 to perform the shut off operation is T1, T1 is defined as follows.

The temperature of the heat receiving section 14 when the output of the heater 10 reaches an excessive heating level that causes the temperature of the medium P to be raised to a predetermined temperature or higher is defined as T2. T1 is defined to satisfy T1<T2. The term "the temperature of the medium P is raised to a predetermined temperature or higher" herein means that the temperature of the medium P is raised to a temperature (reference temperature) at which a quality problem occurs to the medium P. Using the stop section 16 that satisfies the relation T1<T2 allows the emission of the thermal energy by the heater 10 to be stopped before the temperature of the medium P is raised to a predetermined temperature or higher.

T2 may vary depending on types of the medium P. In this case, T2 can be determined based on the medium having the lowest predetermined temperature among the media to be mainly used in the liquid ejecting apparatus 1.

Alternatively, T1 may be determined as follows. The temperature of the heat receiving section 14 when the output of the heater 10 reaches an excessive heating level that causes the temperature of the liquid ejected on the medium P to become a predetermined temperature or higher is defined as T3. T1 may be defined to satisfy T1<T3. The term "the temperature of the liquid ejected on the medium P is raised to a predetermined temperature or higher" means that the temperature of the liquid ejected on the medium P is raised to a temperature (reference temperature) at which a quality problem occurs to the liquid ejected on the medium P. Using the stop section 16 that satisfies the relation T1<T3 allows the emission of the thermal energy by the heater 10 to be stopped before the temperature of the liquid ejected on the medium P is raised to a predetermined temperature or higher.

There are two predetermined temperatures, T2 and T3, as a predetermined temperature for determining T1. In this case, T2 and T3 are compared, and then T1 can be determined based on the lower temperature as a predetermined temperature. That is, taking into consideration which is more susceptible to heat between the medium P and the liquid, T1 can be determined based on that is more susceptible to heat.

As the stop section 16, for example, a thermostat may be used. The thermostat is configured to switch the electric circuit between an energized state and an non-energized state by using a bimetal or the like in response to temperature change. There are automatic reset type thermostats which automatically return to the energized state in response to temperature change when they are in the non-energized state and manual reset type thermostats which manually return to the energized state. Either the automatic reset type or the manual reset type can be used as the stop section 16. However, the manual reset type can improve the safety.

Further, a temperature fuse may be used as the stop section 16. Unlike the thermostat, the temperature fuse is not configured to return to the energized state. Accordingly, the temperature fuse can further improve the safety.

In addition, the stop section 16 can be disposed at a position which is not in contact with the heat receiving section 14. For example, the stop section 16 and the heat receiving section 14 can be spaced from each other by a specific distance. The specific distance may be, for example, within one centimeter. Further, another member (buffering member) may be provided between the stop section 16 and the heat receiving section 14. However, the stop section 16 is preferably mounted at a position which is in contact with the heat receiving section 14 in order to accurately detect the temperature of the heat receiving section 14.

In summary, by providing the liquid ejecting apparatus 1 which includes the heat receiving section 14 that is disposed at a position on the first direction side with respect to the heater 10 and between the heater 10 and the medium supporting section 2 when the first direction is defined as a direction from the heater 10 to the medium supporting section 2 so as to receive the thermal energy emitted from the heater 10, and the stop section 16 that is configured to stop the heater 10 when the temperature of the heat receiving section 14 becomes a predetermined temperature or higher, the following advantageous effect can be obtained.

The heat receiving section 14 can receive the thermal energy which is directed from the heater 10 to the medium P. Then, when the temperature of the heat receiving section 14 becomes a predetermined temperature or higher by receiving the thermal energy directed from the heater 10 to the medium P, the stop section 16 stops the heater 10. Accordingly, the heater 10 can be stopped before the thermal energy emitted from the heater 10 reaches the excessive heating level that causes the temperature of the medium P to be raised to a predetermined temperature or higher.

The liquid ejecting apparatus 1 further includes a blowing section 18 that is configured to generate an air flow. The blowing section 18 is disposed in the vicinity of the heater 10. The term "in the vicinity of the heater 10" as used herein refers to, for example, within the radius of 30 cm from the heater 10. In this embodiment, the blowing section 18 is disposed downstream to the heater 10 in the transportation direction. Further, a plurality of blowing sections 18 is arranged in the intersecting direction. In this embodiment, three blowing sections 18 are provided.

Further, the blowing section 18 includes a propeller having a plurality of vanes. The blowing section 18 is configured to generate an air flow by rotating the propeller. The air flow may be, for example, an air flow 22 which is directed from the upper side of the blowing section 18 to the lower side of the blowing section 18. The blowing section 18 serves as a blowing section that blows air by generating an air flow.

The blowing section 18 can invert the direction of the generated air flow by inverting the rotation direction of the propeller. The blowing section 18 can blow air by generating the air flow 22 which is directed from the upper side of the blowing section 18 to the lower side of the blowing section 18 when the propeller rotates in a first rotation direction. Further, when the propeller rotates in a second direction which is opposite to the first rotation direction, the blowing section 18 can blow air by generating the air flow which is directed from the lower side of the blowing section 18 to the upper side of the blowing section 18.

The liquid ejecting apparatus 1 further includes a housing, which is not shown in the figure. The components such as the head 8 and the heater 10 are covered by the housing. Further, at least part of the medium P which is supported by the medium supporting section 2 is covered by the housing. The portion covered by the housing is referred to as the inside of the liquid ejecting apparatus 1. In addition, the liquid ejecting apparatus 1 may include a plurality of housings. For example, the housing that covers the head 8 and the housing that covers the heater 10 may be separately provided.

The inside of the liquid ejecting apparatus 1 can be cooled by allowing the air flow generated by the blowing section 18 to pass through the liquid ejecting apparatus 1. The term "to cool the inside of the liquid ejecting apparatus 1" may include to cool the components such as the head 8 and the heater 10 which are provided in the liquid ejecting apparatus 1, or to cool at least part of the medium P which is supported by the medium supporting section 2. In this embodiment, since the blowing section 18 is disposed in the vicinity of the heater 10, the components in the vicinity of the heater 10 or an area of the medium P which is in the vicinity of the heater 10, which is most likely to be heated, can be cooled.

The liquid ejecting apparatus 1 further includes a cover member 20 that covers at least part of the stop section 16. The cover member 20 serves as a protective section that protects the stop section 16. By providing the cover member 20, the stop section 16 can be protected from various external factors. The external factors may include an outside air, an air flow generated by the blowing section 18, impact from the outside, dust, and water.

For example, the cover member 20 can prevent the effect of the outside air on the stop section 16. When the outside air is especially at a high temperature or low temperature, the stop section 16 which is in contact with the outside air is affected by the temperature of the outside air and fails to precisely detect the temperature of the heat receiving section 14. By providing the cover member 20, the stop section 16 can be prevented from being affected by the outside air and can detect the temperature of the heat receiving section 14 with precision. Accordingly, the heater 10 can be stopped in a reliable manner before the thermal energy emitted from the heater 10 reaches the excessive heating level.

In the case where the blowing section 18 is provided, the cover member 20 is particularly effective. It is because the cover member 20 can block the air flow directed to the stop section 16 of the air flow generated by the blowing section 18. When the stop section 16 is in contact with the outside air, the stop section 16 is affected by the temperature of the air flow and fails to precisely detect the temperature of the heat receiving section 14. By providing the cover member 20, the stop section 16 can be prevented from being affected by the air flow and can detect the temperature of the heat receiving section 14 with precision.

Further, by providing the cover member 20, the stop section 16 can be protected from external factors such as impact from the outside and deposition of dust. Since such external factors may cause failure of the stop section 16, the cover member 20 can prevent the stop section 16 from being damaged by external factors.

In summary, by providing the liquid ejecting apparatus 1 which includes the cover member 20 that covers at least part of the stop section 16, the following advantageous effect can be obtained.

The stop section 16 can be prevented from being affected by external factors and can detect the temperature of the heat receiving section 14 with precision. Accordingly, the heater 10 can be stopped in a reliable manner before the thermal energy emitted from the heater 10 reaches the excessive heating level. Further, the stop section 16 can be protected from external factors, thereby preventing a failure of the stop section 16 due to external factors.

Although the cover member 20 preferably covers a large area of the stop section 16 as possible, the cover member 20 may not entirely cover the stop section 16. By providing the cover member 20 that covers part of the stop section 16, the cover member can be made of less material and the cost of the cover member can be reduced.

The cover member 20 can cover at least part of the heat receiving section 14. In this embodiment, the cover member 20 covers part of the heat receiving section 14. The heat receiving section 14, when affected by the outside air or air flow, may fail to precisely detect the thermal energy emitted onto the medium P. Accordingly, by providing the cover member 20 that covers at least part of the heat receiving section 14, the heat receiving section 14 can be prevented from being affected by external factors. Therefore, the thermal energy emitted onto the medium P can be detected with precision.

Figure 2:
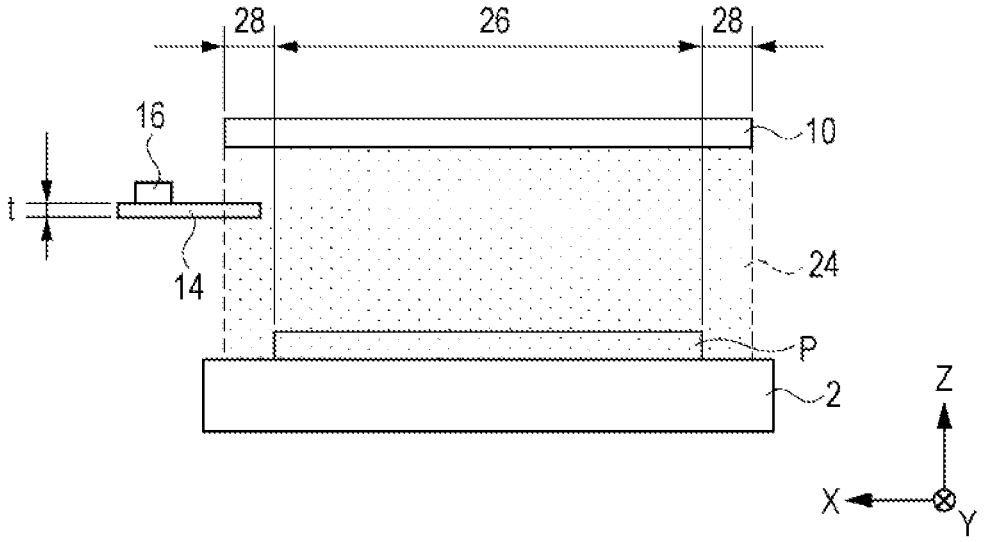
FIG. 2 is a schematic front cross-sectional view of the liquid ejecting apparatus according to the embodiment.

Next, the heater 10 and the heat receiving section 14 will be described in detail. FIG. 2 is a schematic front cross-sectional view of the liquid ejecting apparatus according to the embodiment. In FIG. 2, the reflector 12 and the cover member 20 are not shown for convenience of illustration of the heater 10 and the heat receiving section 14.

An emission range 24 is an area in which the heater 10 can emit the thermal energy in the intersecting direction. At this time, at least part of the heat receiving section 14 is preferably included in the emission range 24 of the thermal energy of the heater 10. It is because the heat receiving section 14 can directly receive the thermal energy which is directed from the heater 10 to the medium P. As shown in FIG. 2, the heat receiving section 14 of this embodiment is disposed with part of the heat receiving section 14 being included in the emission range 24. Alternatively, the heat receiving section 14 may be disposed with the entire heat receiving section 14 being included in the emission range 24.

By providing a configuration in which part of the heat receiving section 14 is included in the emission range 24 of the thermal energy of the heater 10, the following advantageous effect can be obtained.

Since the heat receiving section 14 can directly receive the thermal energy which is directed from the heater 10 to the medium P, the thermal energy emitted from the heater 10 to the medium P can be detected with precision. Accordingly, the heater 10 can be stopped in a reliable manner before the thermal energy emitted from the heater 10 reaches the excessive heating level.

Further, the length of the heater 10 in the intersecting direction is longer than the length of the medium P in the intersecting direction such that part of the heater 10 is located outside the medium P. In this configuration, the heater 10 includes a first area 26 and a second area 28. The first area 26 in the heater 10 is an area which opposes the medium P when the medium P is supported by the medium supporting section 2. The second area 28 in the heater 10 is an area which does not oppose the medium P when the medium P is supported by the medium supporting section 2.

That is, part of the heater 10 is located outside the medium P, and the part of the heater 10 which is located outside the medium P corresponds to the second area 28. In other words, margin portions of the heater 10 correspond to the second area 28.

The length of the medium P in the intersecting direction varies depending on types of the medium P. In this case, the length of the heater 10 in the intersecting direction can be determined based on the medium having the largest length (maximum usable medium) in the intersecting direction among the media which are usable in the liquid ejecting apparatus 1.

For example, in the case where a medium having a length of 64 inches in the intersecting direction is the maximum usable medium of the liquid ejecting apparatus 1, the length of the heater 10 in the intersecting direction may be larger than 64 inches. For example, the length of the heater 10 in the intersecting direction may be 66 inches. In this case, the first area 26 corresponds to 64-inch portion and the second area 28 corresponds to 2-inch portion. The second area 28 may be provided as separate portions on the positive end of the X axis and the negative end of the X axis in the heater 10 so that the positive end of the X axis and the negative end of the X axis have 2 inches in total, or alternatively, a continuous 2-inch portion may be provided either on the positive end of the X axis or the negative end of the X axis. Further, when the second area 28 is provided as separate portions on the positive end of the X axis and the negative end of the X axis in the heater 10, the length of the positive end of the X axis and the length of the negative end of the X axis may be different.

In this configuration, the heat receiving section 14 is preferably disposed at a position which opposes an area which includes the second area 28 of the heater 10. As shown in FIG. 2, the heat receiving section 14 of this embodiment is disposed at a position which opposes the second area 28 of the heater 10. In other words, the heat receiving section 14 is disposed at a position which receives the thermal energy of the margin portion of the heater 10. In such a configuration, the thermal energy emitted from the heater 10 to the medium P is not interrupted by the heat receiving section 14. Accordingly, a sufficient thermal energy can be emitted onto the medium P.

Moreover, the area which the heat receiving section 14 opposes may include the first area 26 as long as it includes the second area 28 of the heater 10. However, in order to emit a sufficient thermal energy to the medium P, it is preferable not to include the first area 28 or, if include, a small area as possible. For example, in the area which the heat receiving section 14 opposes, the first area 26 preferably has an area smaller than the second area 28.

In summary, in the liquid ejecting apparatus 1, the heater 10 includes the first area 26 which opposes the medium P when the medium P is supported by the medium supporting section 2 and the second area 28 which does not oppose the medium P, and the heat receiving section 14 is disposed at a position which opposes an area which includes the second area 28 of the heater 10. In other words, the heat receiving section 14 is disposed at a position which opposes the second area 28 of the heater 10. Accordingly, the following advantageous effect can be obtained.

The heat receiving section 14 can receive the thermal energy directed from the heater 10 to the medium P without interrupting the thermal energy emitted onto the medium P. Accordingly, the heater 10 can be stopped before the thermal energy emitted from the heater 10 reaches the excessive heating level while allowing a sufficient thermal energy to be emitted onto the medium P.

Further, the heat receiving section 14 preferably has a thermal diffusivity of 80 ($mm^2$/sec) or more. The thermal diffusivity is an index that indicates a transfer rate of thermal energy in an object. The thermal diffusivity of an object is obtained from the thermal conductivity divided by the product of specific heat and density. The thermal diffusivity may also be referred to as temperature conductivity or temperature diffusivity.

The table 1 below shows the result of evaluation as to whether the medium P has a quality problem depending on different thermal diffusivity of the heat receiving section 14. When the medium P did not have a quality problem by visual observation, the result was evaluated as OK. On the other hand, when the medium P had a quality problem, the result was evaluated as NG.

TABLE 1

| Thermal diffusivity ($mm^2$/sec) | Evaluation result |
|---|---|
| 50 | NG |
| 60 | NG |

TABLE 1-continued

| Thermal diffusivity ($mm^2$/sec) | Evaluation result |
|---|---|
| 70 | NG |
| 80 | OK |
| 90 | OK |
| 100 | OK |

As shown in table 1, the results were OK when the thermal diffusivity of the heat receiving section 14 was 80 $m^2$/sec) or more. When the thermal diffusivity of the heat receiving section 14 is 80 ($m^2$/sec) or more, a necessary period of time from when the heat receiving section 14 receives the thermal energy to when the temperature of the heat receiving section 14 increases is shortened. Accordingly, the stop section 16 can quickly stop the heater 10 before the thermal energy emitted from the heater 10 reaches the excessive heating level.

The thermal diffusivity varies depending on properties of the material. Accordingly, in order to ensure the thermal diffusivity of the heat receiving section 14 to be 80 ($m^2$/sec) or more, the material may be appropriately selected. For example, an aluminum may be used as a material to ensure the thermal diffusivity of 80 ($mm^2$/sec) or more.

Further, the heat receiving section 14 preferably has an emissivity of 0.8 or more. The emissivity is an index that indicates a degree of radiation of electromagnetic wave by an object. The emissivity of an object is obtained from the ratio of the radiation energy radiated by a virtual object (black body) which most efficiently radiates the electromagnetic wave and the radiation energy of the object. It has been found that the emissivity equals the absorptivity of electromagnetic wave of an object. Accordingly, when the thermal energy is emitted as an electromagnetic wave, the object having a high emissivity has a high absorptivity of thermal energy. The emissivity may also be referred to as radiation rate.

The table 2 below shows the result of evaluation as to whether the medium P has a quality problem depending on different emissivity of the heat receiving section 14. When the medium P did not have a quality problem by visual observation, the result was evaluated as OK. On the other hand, when the medium P had a quality problem, the result was evaluated as NG.

TABLE 2

| Emissivity | Evaluation result |
|---|---|
| 0.7 | NG |
| 0.75 | NG |
| 0.8 | OK |
| 0.85 | OK |
| 0.9 | OK |
| 0.95 | OK |

As shown in table 2, the results were OK when the emissivity of the heat receiving section 14 was 0.8 or more. When the emissivity of the heat receiving section 14 is 0.8 or more, the absorptivity of thermal energy of the heat receiving section 14 is improved and the thermal energy emitted onto the medium P can be detected with precision. Accordingly, the heater 10 can be stopped in a reliable manner before the thermal energy emitted from the heater 10 reaches the excessive heating level.

The emissivity varies depending on properties of material, color of material, surface roughness of material and the like. Accordingly, in order to ensure the emissivity of the heat receiving section 14 to be 0.8 or more, the material may be appropriately selected. The material having the emissivity of 0.8 or more may include, for example, ceramic and aluminum processed with alumite treatment.

Further, the heat receiving section 14 is preferably a plate member having a thickness of 0.3 mm or less. The heat receiving section 14 of this embodiment is a plate member. The thickness t shown in FIG. 2 is a thickness of the heat receiving section 14.

The table 3 below shows the result of evaluation as to whether the medium P has a quality problem depending on different thicknesses of the heat receiving section 14. When the medium P did not have a quality problem by visual observation, the result was evaluated as OK. On the other hand, when the medium P had a quality problem, the result was evaluated as NG. Further, aluminum was used as the material of the heat receiving section 14.

TABLE 3

| Thickness t (mm) | Evaluation result |
|---|---|
| 0.1 | OK |
| 0.2 | OK |
| 0.3 | OK |
| 0.4 | NG |
| 0.5 | NG |

As shown in table 3, the results were OK when the thickness of the heat receiving section 14 was 0.3 mm or less. With the thickness t of 0.3 mm or less, the volume of the heat receiving section 14 can be reduced. When the volume of the heat receiving section 14 is reduced, the mass of the heat receiving section 14 is reduced. When the mass of the heat receiving section 14 is reduced, the heat capacity of the heat receiving section 14 is reduced. Then, when the heat capacity of the heat receiving section 14 is reduced, the temperature of the heat receiving section 14 is easily increased. The heat capacity is a quantity of heat necessary for increasing the temperature of an object by 1 degree. The heat capacity of an object is obtained from the product of mass and specific heat.

When the heat receiving section 14 is a plate member having a thickness of 0.3 mm or less, the temperature of the heat receiving section 14 is easily increased. Accordingly, the heater 10 can be stopped in a reliable manner before the thermal energy emitted from the heater 10 reaches the excessive heating level.

In order to reduce the heat capacity of the heat receiving section 14, it is preferable that the thickness t of the heat receiving section 14 is small as possible regardless of the material of the heat receiving section 14. However, the smaller the thickness t is, the lower the strength of the heat receiving section 14 is. Accordingly, it is preferable that the heat receiving section 14 has a small thickness t as long as ensuring the strength of the heat receiving section 14.

Further, at least part of the heat receiving section 14 is preferably made of aluminum. The aluminum is a material having a high thermal diffusivity which is described above. Specifically, the thermal diffusivity of aluminum is approximately 96.8 ($mm^2$/sec).

When at least part of the heat receiving section 14 is made of aluminum, a necessary period of time from when the heat receiving section 14 receives the thermal energy to when the temperature of the heat receiving section 14 increases is shortened. Accordingly, the stop section 16 can quickly stop the heater 10 before the thermal energy emitted from the heater 10 reaches the excessive heating level.

Further, using an aluminum as a material of at least part of the heat receiving section 14 can reduce a load applied to a component on which the heat receiving section 14 is mounted since the aluminum is lightweight. In addition, using an aluminum as a material of at least part of the heat receiving section 14 can reduce the cost of the heat receiving section 14 since the aluminum is inexpensive.

Further, the heat receiving section 14 may be entirely made of aluminum. When the heat receiving section 14 is entirely made of aluminum, the thermal diffusivity becomes uniform, thereby preventing non-uniform temperature distribution in the heat receiving section 14. In addition, burden and cost of manufacturing the heat receiving section 14 can be also reduced.

Further, at least part of the heat receiving section 14 may be made of copper. The copper is a material having a high thermal diffusivity which is described above. Specifically, the thermal diffusivity of copper is approximately 117 ($m^2$/sec).

When at least part of the heat receiving section 14 is made of copper, a necessary period of time from when the heat receiving section 14 receives the thermal energy to when the temperature of the heat receiving section 14 increases is shortened. Accordingly, the heater 10 can be quickly stopped before the thermal energy emitted from the heater 10 reaches the excessive heating level.

Further, the heat receiving section 14 may be entirely made of copper. When the heat receiving section 14 is entirely made of copper, the thermal diffusivity becomes uniform, thereby preventing non-uniform temperature distribution in the heat receiving section 14. In addition, burden and cost of manufacturing the heat receiving section 14 can be also reduced.

As described above, aluminum or copper is suitable for a material of the heat receiving section 14. Either of aluminum or copper may be used for the heat receiving section 14. When aluminum is used for the heat receiving section 14, the heat receiving section 14 is configured to be lightweight and is made with inexpensive cost compared with the heat receiving section 14 made of copper. When copper is used for the heat receiving section 14, the heat receiving section 14 has higher thermal diffusivity compared with the heat receiving section 14 made of aluminum. Alternatively, aluminum and copper may be used for different parts, or an alloy of aluminum and copper may be used.

Further, in consideration solely of thermal diffusivity, any material may be used as long as having the thermal diffusivity of 80 ($m^2$/sec) or more as described above. For example, gold or silver may be used.

Further, when at least part of the heat receiving section 14 is made of aluminum, it is preferable to use aluminum processed with alumite treatment. The alumite treatment is a treatment to form an oxide film on the surface of aluminum. Providing the alumite treatment can increase the emissivity of the heat receiving section 14. Specifically, the emissivity of aluminum which is not processed with alumite treatment is 0.1 or less. On the other hand, the emissivity of aluminum which is processed with alumite treatment is approximately 0.8.

When at least part of the heat receiving section 14 is made of aluminum which is processed with alumite treatment, the absorptivity of thermal energy of the heat receiving section 14 is improved and the thermal energy emitted onto the medium P can be detected with precision. Accordingly, the heater 10 can be stopped in a reliable manner before the thermal energy emitted from the heater 10 reaches the excessive heating level.

Further, providing the alumite treatment on aluminum can increase the corrosion resistance and abrasion resistance. Accordingly, when at least part of the heat receiving section 14 is made of aluminum processed with alumite treatment, the durability of the heat receiving section 14 can be improved.

As described above, according to the liquid ejecting apparatus 1 of this embodiment, in the liquid ejecting apparatus 1 which includes the heat receiving section 14 that receives the thermal energy emitted from the heater 10 and the stop section 16 that is configured to stop the heater 10 when the temperature of the heat receiving section 14 becomes a predetermined temperature or higher, the thermal energy directed from the heater 10 to the medium P can be detected. Accordingly, the heater 10 can be stopped before the thermal energy emitted from the heater 10 reaches the excessive heating level that causes the temperature of the medium P to be raised to a predetermined temperature or higher.

The invention is not limited to the above embodiment, and various modifications and alterations can be made to the above embodiment. Variations will be described below.

Variation 1

Figure 3A:
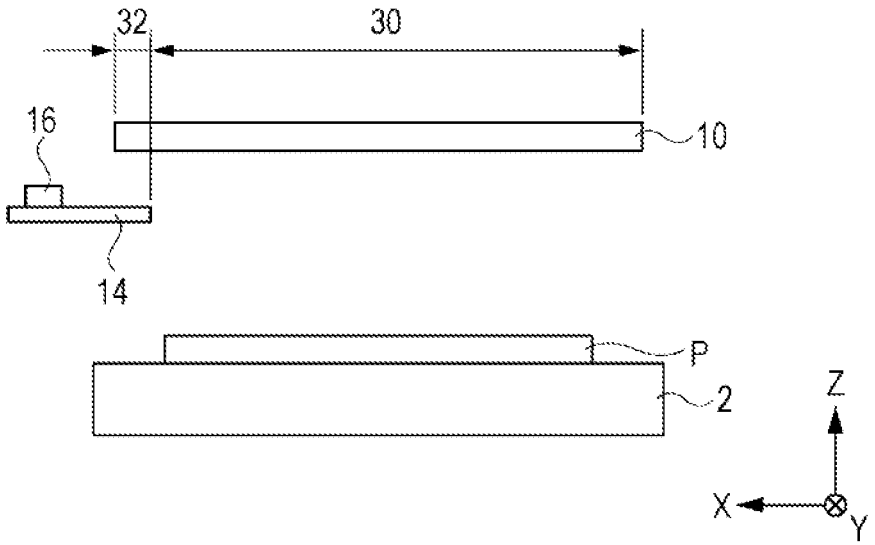
FIG. 3A is a schematic front cross-sectional view of a liquid ejecting apparatus according to a variation 1.

Although the output of thermal energy of the heater 10 of the above embodiment is uniform in the intersecting direction, the invention is not limited thereto. Output area of thermal energy of the heater 10 may be divided into two areas with each area having different output. FIG. 3A is a schematic front cross-sectional view of the liquid ejecting apparatus according to the variation 1. In FIG. 3A, the reflector 12 and the cover member 20 are not shown for convenience of illustration of the heater 10 and the heat receiving section 14. In this variation, the configuration is the same as that of the above embodiment except for the output of thermal energy of the heater 10.

The heater 10 according to the variation 1 includes a first output area 30 and a second output area 32. The output of thermal energy of the second output area 32 is higher than the output of thermal energy of the first output area 30. The thermal energy emitted from the first output area 30 is emitted onto an area which does not include the heat receiving section 14. Further, the thermal energy emitted from the second output area 32 is emitted onto an area which includes the heat receiving section 14. In this configuration, the thermal energy from the first output area 30 is emitted onto the medium P, while the thermal energy from the second output area 32 is emitted onto the heat receiving section 14. Accordingly, the temperature of the heat receiving section 14 is easily increased compared with the temperature of the medium P. This facilitates the operation of the stop section 16.

In summary, the heater 10 has a configuration in which the output of thermal energy emitted onto the area which includes the heat receiving section 14 is higher than the output of thermal energy emitted onto the area which does not include the heat receiving section 14. In other words, the heater 10 has a configuration in which the output of thermal energy in the area which opposes the heat receiving section 14 is higher than the output of thermal energy in the area which does not oppose the heat receiving section 14. Accordingly, the temperature of the heat receiving section 14 is easily increased compared with the temperature of the medium P, which facilitates the operation of the stop section 16. Accordingly, the heater 10 can be stopped in a reliable manner before the thermal energy emitted from the heater 10 reaches the excessive heating level.

The table 4 below shows the result of evaluation by visual observation as to whether the medium P has a quality problem depending on different outputs of thermal energy of the second output area 32. A plurality of media as the medium P was evaluated. Of the media to be evaluated, when all the media did not have a quality problem, the result was evaluated as VG (very good). When more than half of the media did not have a quality problem, the result was G (good). Further, when more than half of the media had a quality problem, the result was NG (no good). In addition, the thermal energy of the second output area 32 is represented with the thermal energy of the first output area 30 as 100%.

TABLE 4

| Output of the thermal energy of the second output area 32 (%) | Evaluation result |
|---|---|
| 90 | NG |
| 100 | G |
| 110 | G |
| 120 | VG |
| 130 | VG |
| 140 | VG |

As shown in FIG. 4, when the output of thermal energy of the first output area 30 is defined as 100%, the output of thermal energy of the second output area 32 is preferably 120% or more. In this configuration, the heater 10 can be stopped before the thermal energy emitted from the heater 10 reaches the excessive heating level that causes the temperature of the medium P to be raised to a predetermined temperature or higher.

In order to ensure the output of thermal energy of the heater 10 to be partially different, the resistance value of the heater 10 may be partially different. As the resistance value becomes larger, the output becomes higher. On the other hand, as the resistance value becomes smaller, the output becomes lower.

Variation 2

Figure 3B:
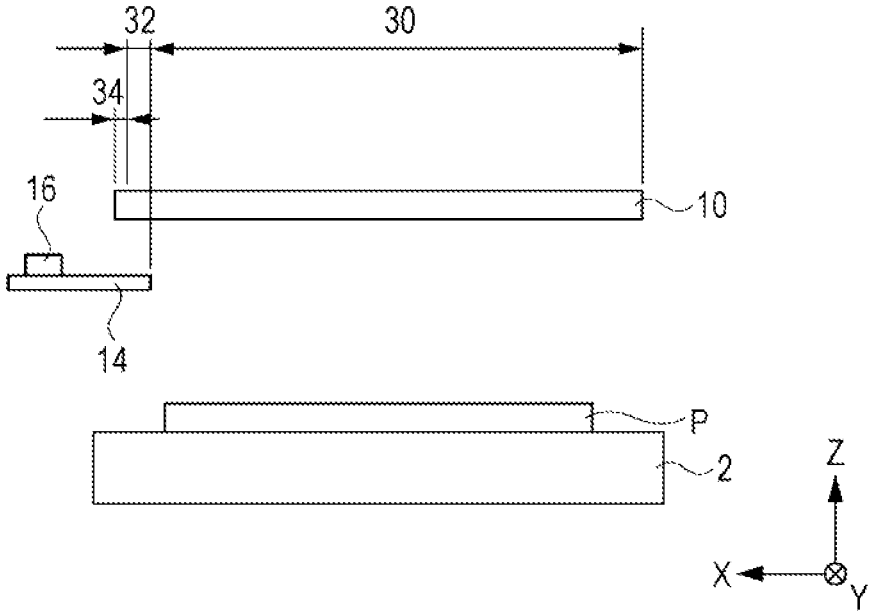
FIG. 3B is a schematic front cross-sectional view of a liquid ejecting apparatus according to a variation 2.

While the output area of thermal energy of the heater 10 is divided into two areas in the variation 1, the output area of thermal energy of the heater 10 may be divided into three areas. In the variation 2, a third output area 34 is added to the configuration of the variation 1. FIG. 3B is a schematic front cross-sectional view of the liquid ejecting apparatus according to the variation 2. In FIG. 3B, the reflector 12 and the cover member 20 are not shown for convenience of illustration of the heater 10 and the heat receiving section 14. In this variation, the configuration is the same as that of the above embodiment except for the output of thermal energy of the heater 10.

The heater 10 according to the variation 2 includes a first output area 30, a second output area 32, and a third output area 34. The third output area 34 is located closer to the stop section 16 than the second output area 32. The second output area 32 is located away from the stop section 16 than the third output area 34. The output of thermal energy of the second output area 32 is higher than the output of thermal energy of the first output area 30. The output of thermal energy of the third output area 34 is higher than the output of thermal energy of the second output area 32. That is, the relation of the thermal energy of the respective areas is as follows: the output of the first output area 30<the output of the second output area 32<the output of the third output area 34.

The thermal energy emitted from the first output area 30 is emitted onto an area which does not include the heat receiving section 14. Further, the thermal energy emitted from the second output area 32, the third output area 34 is emitted onto an area which includes the heat receiving section 14. In this configuration, the thermal energy from the first output area 30 is emitted onto the medium P, while the thermal energy from the second output area 32, the third output area 34 is emitted onto the heat receiving section 14. Accordingly, the temperature of the heat receiving section 14 is easily increased compared with the temperature of the medium P. This facilitates the operation of the stop section 16.

In summary, the heater 10 has a configuration in which the output of thermal energy emitted onto the area which includes the heat receiving section 14 is higher than the output of thermal energy emitted onto the area which does not include the heat receiving section 14. Accordingly, the temperature of the heat receiving section 14 is easily increased compared with the temperature of the medium P, which facilitates the operation of the stop section 16. Accordingly, the heater 10 can be stopped in a reliable manner before the thermal energy emitted from the heater 10 reaches the excessive heating level.

In the variation 2, in the output of thermal energy emitted onto the area which includes the heat receiving section 14, the output of thermal energy emitted from the third output area 34 is higher than the output of thermal energy emitted from the second output area 32. In other words, in the thermal energy emitted onto the area which includes the heat receiving section 14, the output of thermal energy emitted from the area which is located close to the stop section 16 is higher than the output of thermal energy emitted from area located away from the stop section 16. As a result, in the heat receiving section 14, the temperature of the area located close to the stop section 16 is easily increased compared with the temperature of the area located away from the stop section 16, which facilitates the operation of the stop section 16. Accordingly, the heater 10 can be stopped in a reliable manner before the thermal energy emitted from the heater 10 reaches the excessive heating level.

Further, in the heater 10 of the variation 2, the area of the third output area 34 is preferably smaller than the area of the second output area 32. Since the area of the third output area 34 is an area of higher output than the second output area 32, power consumption becomes large as the third output area 34 increases. Accordingly, providing the area of the third output area 34 which is smaller than the area of the second output area 32 allows the stop section 16 to be easily operated while reducing the power consumption.

The table 5 below shows the result of evaluation of the balance between the power consumption and the operability of the stop section 16 depending on different ratios of the area of the second output area 32 to the area of the third output area 34. The ratio of the area of the second output area 32 to the area of the third output area 34 was started with 1:1, and the area of the second output area 32 was gradually increased. The specifically preferable configuration was evaluated as VG (very good), the preferable configuration was evaluated as G (good), and the unpreferable configuration was evaluated as NG (no good).

TABLE 5

| The area of the second output area 32: The area of the third output area 34 | Evaluation result |
|---|---|
| 1:1 | NG |
| 2:1 | G |
| 3:1 | VG |
| 4:1 | G |
| 5:1 | NG |

As shown in FIG. 5, it is specifically preferable that the ratio of the area of the second output area 32 to the area of the third output area 34 is 3:1. It is because the power consumption and the operability of the stop section 16 were particularly balanced.

When the ratio of the area of the second output area 32 to the area of the third output area 34 was 1:1, the area of the third output area 34 was too large and the power consumption was too high, therefore the result was evaluated as NG. When the ratio of the area of the second output area 32 to the area of the third output area 34 is 5:1, the area of the third output area 34 was too small and providing the third output area 34 was less effective, therefore the result was evaluated as NG. When the ratio of the area of the second output area 32 to the area of the third output area 34 was 2:1, 4:1, the power consumption and the operability of the stop section 16 were balanced, although less preferable compared with the case of 3:1. Accordingly, as long as the ratio of the area of the second output area 32 to the area of the third output area 34 is in the range of 2:1 to 4:1, it may not be exactly 3:1. That is, the ratio may be slightly different as long as the ratio is close to 3:1. However, taking into consideration the balance between the power consumption and the stop section 16, it is specifically preferable that the ratio of the area of the second output area 32 to the area of the third output area 34 is 3:1.

Further, in the heater 10 of the variation 2, the output of thermal energy in the respective areas may be any value as long as the relation of the output of the first output area 30<the output of the second output area 32<the output of the third output area 34 is satisfied. The table 6 below shows an example of configuration of the output of the second output area 32 and the output of the third output area 34 when the output of thermal energy in the first output area 30 is defined as 100%.

TABLE 6

| Output of the thermal energy of the second output area 32 (%) | Output of the thermal energy of the third output area 34 (%) |
|---|---|
| 110 | 120 |
| 110 | 130 |
| 120 | 130 |
| 120 | 140 |
| 130 | 140 |
| 130 | 150 |

The configuration shown in the table 6 is merely an example, and it is desirable that the output of thermal energy in the second output area 32 and the output of thermal energy in the third output area 34 are determined as appropriate taking into consideration the area of the respective areas. However, when the ratio of the area of the second output area 32 to the area of the third output area 34 is 3:1, it is specifically preferable that the output of thermal energy of the second output area 32 is 120%, and the output of thermal energy of the third output area 34 is 140%. These are values when the output of thermal energy in the first output area 30 is defined as 100%. With this configuration, the balance between the power consumption and the operability of the stop section 16 can be advantageously maintained.

Other Variations

While the head 8 has a serial head configuration which forms an image on the medium P by ejecting the liquid while moving in the intersecting direction, a line head configuration which forms an image on the medium P by ejecting the liquid without moving in the intersecting direction may be used. When the head 8 is a line head, it is preferable that a plurality of nozzles is arranged in the intersecting direction so that the liquid can be ejected across the length of the medium P in the intersecting direction. In this case, the line head can be formed by arranging a plurality of heads, or alternatively, the line head can be formed by one long head.

Further, the liquid ejecting apparatus 1 may not include a transportation roller. Such a liquid ejecting apparatus may include a flat bed type liquid ejecting apparatus in which the liquid is ejected while the head is moving in a first scanning direction and a second scanning direction and the medium is not transported. In this configuration, the head 8 can be moved in a direction along the X axis (first scanning direction) and a direction along the Y axis (second scanning direction).

Although ink has been described as an example of the liquid which can be ejected from the head 8, other liquid may be ejected. For example, a material in a liquid phase may be used. Examples of liquid may include a material in a liquid state having high or low viscosity, sol, gel water, other inorganic solvent, organic solvent, liquid solution, liquid resin, a material in flow state such as liquid metal (molten metal), and, in addition to liquid as a phase of substance, particles of functional material made of solid substance such as pigment and metal particles, which is dissolved, dispersed or mixed in a solvent. Further, in addition to the above-mentioned ink, typical examples of liquid may include pre-treatment agent, post-treatment agent, liquid crystal and the like. The ink may include various liquid components such as general water-based ink, oil-based ink, gel ink and hot melt ink.

Further, the liquid ejecting apparatus 1 may include a plurality of heaters. For example, additional heater may be disposed between the heater 10 and the head 8 or upstream to the head 8 in the transportation direction. When the plurality of heaters is disposed, a plurality of heat receiving sections or stop sections which correspond to the respective heaters may be provided. Alternatively, only some heaters of the plurality of heaters may include the heat receiving section and stop section of the invention. In this case, it is preferable that the heat receiving section and stop section of the invention are provided at least in the heater having the highest output. It is because that the heater having the highest output most likely to cause an excessive heating of the medium P. Providing the heat receiving section and stop section of the invention in the heater having the highest output can effectively prevent the medium P from being excessively heated.

Further, the liquid ejecting apparatus 1 may not include the reflector 12. In the case where a sufficient thermal energy can be emitted onto the medium P without providing the reflector 12, the reflector 12 may not be provided. Without providing the reflector 12, the liquid ejecting apparatus 1 may have a simpler configuration, thereby reducing the burden and cost of manufacturing the liquid ejecting apparatus 1.

Although the liquid ejecting apparatus 1 has been described to have three blowing sections 18, one or two blowing sections 18 may be provided. Alternatively, four blowing sections 18 may be provided. A necessary number of blowing sections 18 to cover the length of the heater 10 in the intersecting direction may be provided.

Further, the liquid ejecting apparatus 1 may not include the blowing section 18. When it is not necessary to cool the inside of the liquid ejecting apparatus 1, the blowing section 18 may not be provided. Without providing the blowing section 18, the liquid ejecting apparatus 1 may have a simpler configuration, thereby reducing the burden and cost of manufacturing the liquid ejecting apparatus 1.

Further, the liquid ejecting apparatus 1 may not include the cover member 20. When the stop section 16 is under the environment which is less likely to be exposed to external factors, or is less likely to be damaged by external factors, the cover member 20 may not be provided. Without providing the cover member 20, the liquid ejecting apparatus 1 may have a simpler configuration, thereby reducing the burden and cost of manufacturing the liquid ejecting apparatus 1.

Although the heat receiving section 14 has been described as a plate member, a member not in a plate shape may be used. Specifically, a member of block shape or spherical shape may be used. However, in order to reduce the heat capacity of the heat receiving section 14, the volume of the heat receiving section 14 is preferably small as possible. Further, in order to facilitate receiving of the thermal energy emitted from the heater 10, it is preferable that a portion of the heat receiving section 14 which opposes the heater 10 has a large area. In light of the above conditions, it is specifically preferable that the heat receiving section 14 is in a plate shape.

While the output area of thermal energy of the heater 10 is divided into two areas in the variation 1, and the output area of thermal energy of the heater 10 is divided into three areas in the variation 2, the output area may be divided into four or more areas. As the number of output areas increases, the emitted thermal energy can be more precisely controlled. Further, as the number of output areas increases, the power consumption can be more precisely adjusted.

Further, in the variations 1 and 2, the thermal energy emitted onto the area which does not include the heat receiving section 14 is not partially different. However, the thermal energy emitted onto the area which does not include the heat receiving section 14 may be partially different. The term "the output may be partially different" herein may include that the output may not be partially provided. With this configuration, the thermal energy with different intensity may be emitted onto the medium P or the thermal energy may be emitted onto the necessary area only.

The invention may be implemented by combining the above embodiment and variations as appropriate.

Further, the configuration described in the above embodiment and variations is particularly effective in the liquid ejecting apparatus which uses water-based ink containing water-soluble organic solvent. It is because there are many types of media used for the liquid ejecting apparatus which uses such ink to form an image, and accordingly, there is often a risk that the media not resistant to heat is used. However, it should be noted that the liquid ejecting apparatus to which the configuration of the invention is applicable is not limited to the foregoing liquid ejecting apparatuses.

The media which can be used in the liquid ejecting apparatus 1 may include an acrylic media such as acrylic resin, PET resin and vinyl chloride resin, cloths and papers. Further, the media having an adhesion surface for adhesion to a wall surface or the like after printing is performed on the media may be used. When the material of the media or the adhesion surface of the media is not resistant to heat, the configuration of the invention is particularly effective.

The entire disclosure of Japanese Patent Application No. 2013-181899, filed Sep. 3, 2013 is expressly incorporated reference herein.

What is claimed is:

1. A liquid ejecting apparatus comprising:

an ejection section that ejects a liquid;

a medium supporting section that supports a medium onto which the liquid is ejected;

a heater that is disposed at a position which is not in contact with the medium supporting section and is configured to emit a thermal energy;

a heat receiving section that receives the thermal energy emitted from the heater; and a stop section that detects a temperature of the heat receiving section, and stops the heater when a detected temperature of the heat receiving section becomes a predetermined temperature or higher, wherein the heat receiving section is disposed at a position on a first direction side with respect to the heater and between the heater and the medium supporting section, when the first direction is defined as a direction which is directed from the heater to the medium supporting section, a portion of the heating receiving section is disposed outside of the medium supporting section in a direction orthogonal to the first direction.

2. The liquid ejecting apparatus according to claim 1, wherein the heater includes a first area which opposes the medium when the medium is supported by the medium supporting section and a second area which does not oppose the medium when the medium is supported by the medium supporting section, and the heat receiving section is disposed at a position which opposes the second area of the heater.

3. The liquid ejecting apparatus according to claim 1, wherein the heater has a configuration in which an output of the thermal energy in an area which opposes the heat receiving section is higher than an output of thermal energy in an area which does not oppose the heat receiving section.

4. The liquid ejecting apparatus according to claim 1, wherein the heat receiving section has a thermal diffusivity of 80 ($mm^2$/sec) or more.

5. The liquid ejecting apparatus according to claim 1, wherein the heat receiving section has an emissivity of 0.8 or more.

6. The liquid ejecting apparatus according to claim 1, wherein the heat receiving section is a plate shaped member having a thickness of 0.3 mm or less.

7. The liquid ejecting apparatus according to claim 1, further comprising a cover member that covers at least part of the stop section.

8. The liquid ejecting apparatus according to claim 1, wherein the heat receiving section is separated from the medium.

* * * * *